US005479066A

United States Patent [19]

Willems et al.

[11] Patent Number: 5,479,066

[45] Date of Patent: Dec. 26, 1995

[54] ELECTRIC LAMP

[75] Inventors: Johannes J. G. S. A. Willems, Wijlre, Netherlands; Dieter Wilhelm, Eschweiler, Germany

[73] Assignee: U.S. Philips Corporation, New York, N.Y.

[21] Appl. No.: 219,057

[22] Filed: Mar. 29, 1994

[30] Foreign Application Priority Data

Mar. 31, 1993 [EP] European Pat. Off. ..... 93200914

[51] Int. Cl.[6] ..... H01K 1/46

[52] U.S. Cl. ..... 313/318.05; 313/318.01; 313/318.06; 362/267; 174/17.08; 439/271

[58] Field of Search ..... 362/267; 313/318, 313/318.06, 318.07, 318.08, 318.09, 318.1, 318.11, 318.12, 318.05; 174/17.08; 437/271

[56] References Cited

U.S. PATENT DOCUMENTS

| | | | |
|---|---|---|---|
| 4,473,770 | 9/1984 | Baba et al. | 313/318 |
| 4,507,712 | 3/1985 | Dolan et al. | 362/61 |
| 4,528,619 | 7/1985 | Dolan et al. | 313/318.05 |
| 4,547,838 | 10/1985 | Nakimizu | 362/211 |
| 4,573,754 | 3/1986 | Hill | 439/280 |
| 4,687,965 | 8/1987 | Sanders et al. | 313/318.05 |
| 4,744,011 | 5/1988 | Tomita et al. | 362/80 |
| 5,036,248 | 7/1991 | McEwen et al. | 313/500 |
| 5,197,895 | 3/1993 | Nagamine | 439/271 |
| 5,239,226 | 8/1993 | Seredich et al. | 313/318 |
| 5,312,265 | 5/1994 | Fiori et al. | 439/271 |
| 5,324,208 | 6/1994 | Kodama et al. | 439/271 |

FOREIGN PATENT DOCUMENTS

| | | | |
|---|---|---|---|
| 0129868 | 1/1985 | European Pat. Off. | F21M 7/00 |
| 0172529 | 2/1986 | European Pat. Off. | H01K 1/46 |
| 0193997 | 9/1986 | European Pat. Off. | H01K 1/46 |

*Primary Examiner*—Donald J. Yusko
*Assistant Examiner*—Lawrence O. Richardson
*Attorney, Agent, or Firm*—Brian J. Wieghaus

[57] ABSTRACT

The electric lamp comprises a cap (10) having a housing (11) in a base portion (13) of which holes (14) are present to allow current conductors (3) to extend to contact members (15) of the cap. In the housing (11) a rubber disk (20) is present against the base portion (13), kept pressed against it by a pressing member (30). The rubber disk is pierced by the current conductors (3), sealing the cap and preventing volatile compounds to enter a reflector in which the lamp may be mounted.

15 Claims, 1 Drawing Sheet

ELECTRIC LAMP

BACKGROUND OF THE INVENTION

The invention relates to an electric lamp provided with:

a light-transmitting lamp vessel which is closed in a vacuumtight manner and in which an electric element is arranged connected to current conductors which issue to the exterior from the lamp vessel;

a lamp cap which is securely connected to the lamp vessel and which has a housing of synthetic resin with an outwardly projecting collar and a base portion comprising openings through which the current conductors extend to contact members of the lamp cap, sealing means being present in the housing for sealing off the openings in the base portion around the current conductors.

Such an electric lamp is known from EP 0 129 868-B1. The lamp is suitable for use as a vehicle headlamp when mounted in a reflector. It is desirable in this application that moisture and pollutants cannot deposit in the reflector. The outwardly projecting collar is designed to abut against the reflector so as to limit the depth to which the lamp can be inserted through an opening in the reflector.

Sealing means are present in the known lamp for preventing moisture and pollutants entering the reflector along the current conductors through the lamp cap. After the lamp vessel has been aligned with its electric element relative to the lamp cap, the current conductors are fastened to the contact members in the known lamp. Then a quantity of sealing compound is brought into the lamp cap housing and this compound is made to solidify at a raised temperature during, for example, one hour. A liquid or powdery synthetic resin, for example epoxy resin, is used for this purpose.

A disadvantage of the construction of the known lamp is that the application and drying or curing of the compound is time-consuming and retards the production process. It is also necessary to prevent volatile components from the compound from being released during lamp operation. Another disadvantage is that only those materials can be used which adhere both to the lamp cap and to the current conductors. A further disadvantage is that the sealing compound could pollute the lamp, for example, the lamp vessel.

The lamp cap of the known lamp is a linear one, i.e. the contact members lie in the extended direction of the lamp vessel.

EP 0 172 529-B1 discloses another lamp designed for use in a reflector where the lamp cap has collars around the respective openings in the base portion, which collars are fused to the current conductors after these current conductors have been passed through. A disadvantage of this is that an additional operation is necessary for obtaining a seal. Another disadvantage is the risk that the seal is not permanent owing to the differences in coefficient of thermal expansion between the synthetic resin and the current conductors.

The lamp cap of this lamp is a transverse one, i.e. the contact members extend transverse to the extension of the lamp vessel.

EP 0 193 997-B1 discloses a similar electric lamp in which the space behind the base portion of the lamp cap is filled with a synthetic resin so as to seal off the housing of the lamp cap. However, volatile components could escape from this synthetic resin. The lamp vessel is secured in the lamp cap by means of a metal clamping plate which grips the lamp vessel with clamping force and a metal cylinder which is mounted in the lamp cap and which is welded to the clamping plate. The metal cylinder is fixed by means of twisted tongues which project through the base wall.

SUMMARY OF THE INVENTION

It is an object of the invention to provide an electric lamp of the kind described in the opening paragraph which is of a simple construction which is readily realised, and which nevertheless has a good seal between the lamp cap and the current conductors.

According to the invention, this object is achieved in that a rubber disc is present against the base portion, which disc is pierced by the current conductors and is kept pressed against the base portion by a pressure member fastened in the housing.

It is an advantage that the lamp cap of the lamp according to the invention can be supplied fully complete, provided with sealing means, so as to be assembled with the lamp vessel, and that a manufacturing step for drying or curing of sealing means is dispensed with. A major advantage is, furthermore, that the lamp vessel need not be aligned relative to the sealing means with very high accuracy during this assembly. The rubber disc may be blind where the current conductors will pierce through it. The current conductors themselves will pierce the disc in the spots where they make contact with the disc. It is of no importance, therefore, if the current conductors of one lamp according to the invention do not make contact with the disc in exactly the same location as the current conductors of other lamps.

The lamp cap of the lamp according to the invention may be readily manufactured. The pre-shaped rubber disc is laid against the base portion in the housing of the lamp cap. The pressure member is fastened in the housing, whereby it starts to press the rubber disc against the base portion. The rubber disc then provides a highly gaslight seal to the openings in the base portion. The openings are still sealed in a highly gastight manner after the assembly of lamp vessel with lamp cap, when the current conductors have pierced the rubber disc.

The pressure member may be fastened in the lamp cap housing in one of various manners, for example, with an adhesive, which is not a great disadvantage because the lamp cap may be manufactured a long time before it is assembled with the lamp vessel. Alternatively, however, the pressure member may be fastened in the housing, for example, ultrasonically.

In a favourable embodiment, however, the pressure member has a snap connection with the housing. The sealing by the rubber disc is then obtained quickly and easily by the mere application and pressing home of the pressure member into its end position.

It is advantageous to construct the pressure member in such a way, for example as a bush, that it projects from the lamp cap housing at the outwardly projecting collar and forms an extension of the housing. The portion of the lamp cap which will lie in a reflector, in which the lamp can be used, is then formed by the pressure member. This renders it possible to manufacture the pressure member only from a synthetic resin which is resistant to the comparatively high temperature inside the reflector during lamp operation, and to have the lamp cap housing consist of a less heat-resistant material. The pressure member may then have a circumferential groove for accommodating an elastic, for example rubber ring. This ring prevents volatile substances from penetrating between the lamp cap and the reflector into the reflector.

The lamp vessel may be connected to the lamp cap in a known manner, for example, be fastened to a metal plate accommodated in the lamp cap by means of an adhesive compound, as in the lamp of EP 0 129 868 B1. It is more favourable, however, when the use of an adhesive compound is avoided, for example through the use of a metal mounting member which holds the lamp vessel with clamping force and is connected to the lamp cap, for example in that material of the lamp cap has penetrated the mounting member during an ultrasonic heating thereof, as in the lamp of EP 0 172 529 B1.

In a favourable embodiment, however, the lamp cap has a connection to a cylindrical portion of a metal mounting member, for example, a snap connection or a scrape connection. This cylindrical portion is readily mounted during the manufacture of the lamp cap in that it is pressed into the lamp cap, into the housing itself or into the pressure member of the lamp cap. A metal sleeve or a metal clamping plate may hold the lamp vessel with clamping force. When the lamp vessel is being mounted in the lamp cap, the lamp vessel may be aligned relative to the lamp cap, after which the two portions of the mounting member are fastened to one another, for example, with resistance or laser welds.

A wide variety of synthetic resins may be used in the lamp cap, for example, thermoplastic synthetic resins, for example, such resins charged with powder or with fibres, such as glass powder or glass fibres, for example polyether imide, polyether sulphon, polyether sulphide, polyphenylene sulphide, polybutylene terefthalate, etc., the synthetic resin last mentioned being particularly suitable for being used for the lamp cap housing if the latter extends only up to the projecting collar.

The electric element of the electric lamp according to the invention may be, for example, an incandescent body, possibly in an inert gas comprising a halogen. Alternatively, however, the element may be a pair of electrodes in an ionizable gas.

The lamp cap of the electric lamp according to the invention is of a universal construction which is suitable both for a linear and for a transverse lamp cap.

BRIEF DESCRIPTION OF THE DRAWINGS

An embodiment of the electric lamp according to the invention is shown in the drawing, in which.

DESCRIPTION OF THE PREFERRED EMBODIMENTS

Figure 1A:
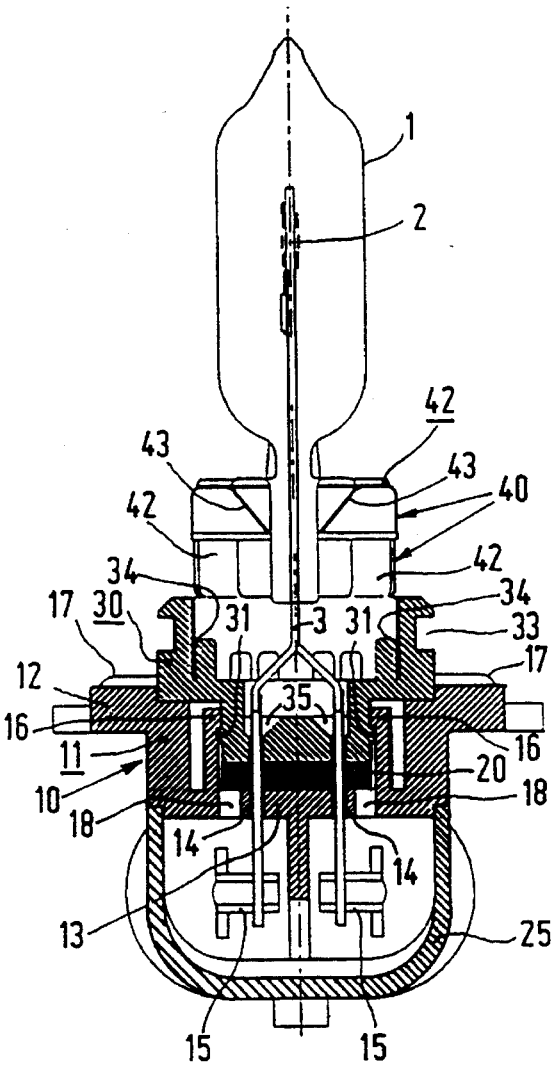
FIG. 1*a* shows a lamp in side elevation, with the lamp cap in cross-section.

In the drawing, the electric lamp has a light-transmitting lamp vessel 1 which is closed in a vacuumtight manner, which is made, for example, of hard glass, and in which an electric element 2 is arranged, in the Figure a tungsten incandescent body, connected to current conductors 3 which issue from the lamp vessel to the exterior. The lamp shown has a filling of rare gas to which hydrogen bromide was added.

A lamp cap 10 is securely connected to the lamp vessel 1. The lamp cap comprises a synthetic-resin housing 11 with a projecting collar 12 which is designed to abut with studs 17 against a reflector in which the lamp can be used. The current conductors 3 extend to contact members 15 of the lamp cap through openings 14 in a base portion 13.

Sealing means are present in the housing for sealing the openings 14 in the base portion 13 around the current conductors 3. A rubber disc 20 lies against the base portion 13, which disc is pierced by the current conductors 3 and is kept pressed against the base portion 13 by a pressure member 30 fastened in the housing 11.

Figure 1B:
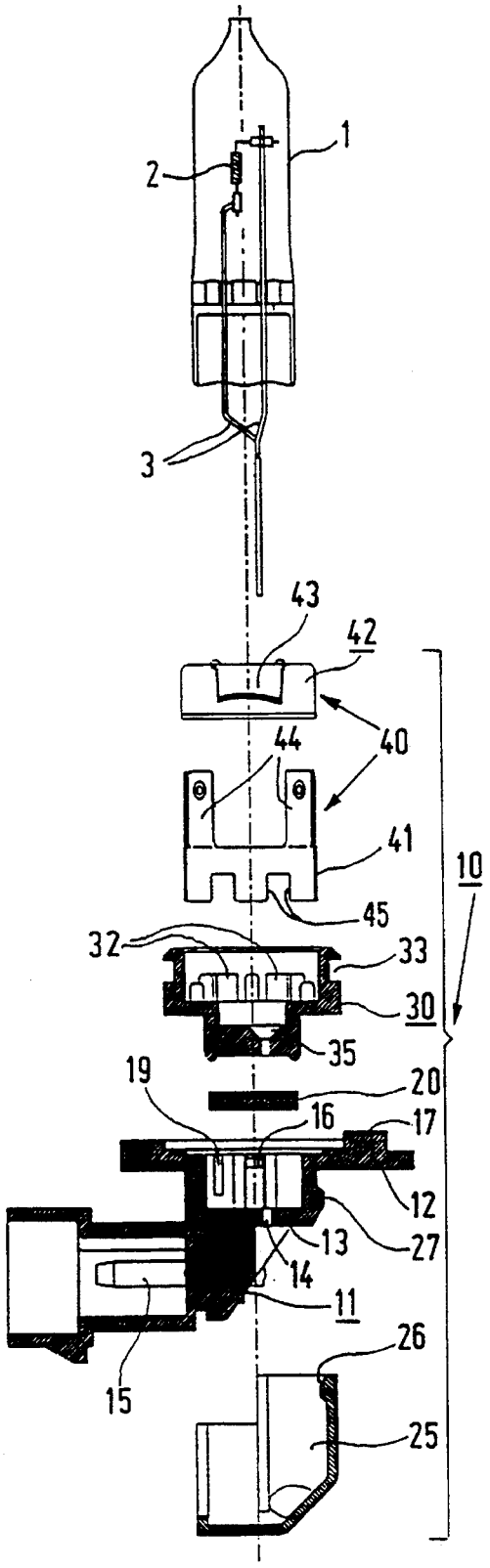
FIG. 1*b* is an exploded view of the lamp of FIG. 1 rotated through 90° .

The rubber disc 20 shown in FIG. 1*b* is fully blind. The openings 14 are sealed off in a highly gaslight manner through the application of the disc and pressing home thereof by the pressure member 30.

The pressure member 30 has a snap connection 31, 16 with the housing 11. In the embodiment shown, hooks 16 in the housing cooperate with ridges 31 at the pressure member for this purpose. The mere operation of pressing home the pressure member causes the disc 20 to seal off the openings 14. It is true that openings 18 are still present in the base portion in the embodiment drawn, through which opening the mould used has shaped the hooks 16. As will be come apparent, however, no volatile substances can enter a reflector in which the lamp will be used through these openings. It is also possible to obtain hooks 16 or similar snapping means in the housing without the openings 18, but in that case a more complicated mould is necessary.

The pressure member in the embodiment shown projects from the housing 11 at the collar 12. It has a circumferential groove 33 for accommodating a sealing ring, for example made of rubber, which seals the lamp cap 10 on an opening in a reflector. Volatile substances which might flow through the openings 18 along the hooks 16 between the housing 11 and the pressure member 30 are prevented from entering the reflector by this sealing ring. The housing 11 has a groove 19 which can accommodate a projection of the pressure member 30 for bringing and keeping the pressure member in its correct rotational position in the housing. The pressure member is provided with funnels 35 for guiding the current conductors towards the openings 14 in the base portion 13.

In FIG. 1*a*, a metal mounting member 40 connects the lamp vessel 1 to the lamp cap 10. A cylindrical portion 41 of this member has a scrape connection 42, 32 (see FIG. 1*b*) with the lamp cap 10. For this purpose, the cylindrical portion has recesses with toothed sides 45. Projections 32 are present in the pressure member into which the toothed sides grip. Grooves 34 keeping the cylindrical portion clamped in are present in the pressure member.

The lamp cap 10 provided with the housing 11 with contact members 15, the rubber disc 20, the pressure member 30 and the cylindrical portion 41 of the mounting member 40, all assembled together, may be supplied to the production line of the burner: lamp vessel 1, electric element 2 and current conductors 3. The burner 1, 2, 3 is provided with the clamping plate 42 of the mounting member 40. This part has resilient tags 43 between which the lamp vessel can be passed and which then hold the lamp vessel securely.

The sub-assembly of burner 1, 2, 3 and clamping plate 42 is subsequently inserted into the sub-assembly of the lamp cap 10, whereby the current conductors 3 will pierce the rubber disc 20. The electric element is then aligned relative to the lamp cap housing 11, after which connections are made between tongues 44 at the cylindrical portion 41 and the clamping plate 42. The current conductors 3 are connected to respective contact members 15, and the connection is closed off with a cover 25 which is passed over the housing and makes a snap connection 26, 27 therewith. There is no need to fill up the space below the cover with a synthetic resin. The lamp, provided with a transverse lamp cap 10 in the drawing, is ready for use.

We claim:

1. An electric lamp, comprising:

a light-transmitting lamp vessel closed in a vacuum tight manner, said lamp vessel including an an electric element arranged within said lamp vessel and current conductors connected to the electric element and issuing to the exterior from the lamp vessel;

a lamp cap securely connected to the lamp vessel, said lamp cap having a housing of synthetic resin with an outwardly projecting collar, a base portion comprising openings through which the current conductors extend, and contact members connected to the current conductors, and sealing means present in the housing for sealing off the openings in the base portion around the current conductors, said sealing means comprising a rubber disc present against the base portion, which disc is (i) free of preformed apertures at the area of the holes in the base portion and (ii) is pierced only by the current conductors, and a pressure member fastened in the housing which presses the rubber disc against the base portion.

2. An electric lamp as claimed in claim 1, characterized in that the pressure member has a snap connection with the housing.

3. An electric lamp as claimed in claim 2, characterized in that the pressure member projects from the housing adjacent the collar.

4. An electric lamp as claimed in claim 2, characterized in that a metal mounting member connects the lamp vessel to the lamp cap, the metal mounting member having a cylindrical portion with a scrape connection with the lamp cap.

5. An electric lamp as claimed in claim 3, characterized in that a metal mounting member connects the lamp vessel to the lamp cap, the metal mounting member having a cylindrical portion with a scrape connection with the pressure member.

6. An electric lamp as claimed in claim 2, characterized in that a metal mounting member connects the lamp vessel to the lamp cap, the metal mounting member having a cylindrical portion with a scrape connection with the pressure member.

7. An electric lamp as claimed in claim 1, characterized in that a metal mounting member connects the lamp vessel to the lamp cap, the metal mounting member having a cylindrical portion with a scrape connection with the pressure member.

8. An electric lamp as claimed in claim 1, characterized in that a metal mounting member connects the lamp vessel to the lamp cap, the metal mounting member having a cylindrical portion with a scrape connection with the lamp cap.

9. An electric lamp as claimed in claim 1, characterized in that the pressure member projects from the housing adjacent the collar.

10. An electric lamp as claimed in claim 9, characterized in that a metal mounting member connects the lamp vessel to the lamp cap, the mounting member having a cylindrical portion of this mounting member has a scrape connection with the pressure member.

11. An electric lamp, comprising:

a) a lamp vessel energizeable for emitting light, said lamp vessel including current conductors extending therefrom; and b) a lamp cap fixed to the lamp vessel, said lamp cap including (i) lamp contacts connected to said current conductors, (ii) a wall between said lamp contacts and said lamp vessel, said wall including apertures through which said current conductors extend, and (iii) sealing means for sealing said current conductors and apertures at said wall in a gas-tight manner, said sealing means consisting of a resilient barrier against said wall and a pressure member compressing said resilient barrier against said wall, at the area of said apertures in said wall (1) said resilient barrier being free of pre-formed openings, (2) the only break in said resilient barrier being paths pierced by said current conductors, the resilient element providing a gas-tight seal with said current conductors along said pierced paths and (3) the pressure member compressing the resilient element against said wall to provide a gas-tight seal between the wall and the apertures.

12. An electric lamp according to claim 11, wherein said resilient barrier is a rubber disc.

13. An electric lamp for a vehicle, comprising:

a) a first sub-assembly comprising (i) a lamp vessel energizeable for emitting light, said lamp vessel including current conductors extending therefrom, and (ii) a holder holding said lamp vessel; and b) a second sub-assembly comprising a lamp cap of synthetic material having a base portion with lamp cap contacts, said base portion including a base wall with openings for receiving the current conductors, a body portion adjacent the base wall having a body opening communicating with said base wall, a resilient barrier against said base wall, at the area of said apertures in said base wall said resilient barrier being free of pre-formed openings, a pressure member fixed in said body opening, said pressure member compressing said resilient barrier against said base wall, forming a gas tight seal at the area of said openings in said base wall, and a mounting member fixed in said circumferential wall portion for connection to said lamp vessel holder, for connecting said lamp vessel holder to said mounting member and said current conductors to said lamp cap contacts, said current conductors being insertable through said pressure member, through said resilient barrier, and through said holes in said base wall for connection to said lamp contacts, said current conductors being connected to said lamp contacts and said lamp vessel holder being fixed to said mounting member, the only break in said resilient barrier being paths pierced by said current conductors in passing therethrough to said lamp contacts, the resilient element providing a gas-tight seal with said current conductors along said pierced paths.

14. An electric lamp according to claim 13, wherein said resilient barrier is a rubber disc.

15. An electric lamp according to claim 13, wherein said pressure member has a snap connection with said body portion.

* * * * *